US007837512B1

(12) United States Patent
Yin et al.

(10) Patent No.: US 7,837,512 B1
(45) Date of Patent: Nov. 23, 2010

(54) AUDIO JACK CONNECTOR

(75) Inventors: Te-Hung Yin, Taipei (TW); Shu-Fang Li, Taipei (TW); Jui-Pin Lin, Taipei (TW); Yung-Yi Chen, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/846,827

(22) Filed: Jul. 30, 2010

Related U.S. Application Data

(62) Division of application No. 12/694,276, filed on Jan. 27, 2010.

(30) Foreign Application Priority Data

Jun. 19, 2009 (TW) ..... 98211142 U

(51) Int. Cl.
*H01R 24/04* (2006.01)

(52) U.S. Cl. ..... 439/669

(58) Field of Classification Search ..... 439/668, 439/669

See application file for complete search history.

(56) References Cited

U.S. PATENT DOCUMENTS 2,911,614 A * 11/1959 Davis ..... 439/668

* cited by examiner

*Primary Examiner*—Phuong K Dinh

(57) ABSTRACT

An audio jack connector has an insulating housing. The insulating housing has an inserting hole extending from a front to rear for receiving the audio plug connector and a plurality of recesses communicating with the inserting hole for receiving a plurality of terminals. An elastic body which is disposed in the inserting hole perpendicular to an extending direction of the inserting hole has two opposite tightening arms and a connecting portion interconnected with opposite ends of the tightening arms. A front end of the audio plug connector passes through the elastic body and is restrained by the elastic body. Two tightening arms of the elastic body are against the portions of the front end of the audio plug connector from opposite directions, when the audio plug connector is inserted into the inserting hole of the insulating housing.

1 Claim, 8 Drawing Sheets

AUDIO JACK CONNECTOR

CROSS-REFERENCES TO RELATED APPLICATIONS

This is a division of U.S. application Ser. No. 12/694,276, filed Jan. 27, 2010, which is incorporated herewith in its entirety by reference.

BACKGROUND OF THE INVENTION

1. Field of the Invention

The present invention relates to an electrical connector, and more particularly to an audio jack connector capable of transmitting audio signals.

2. The Related Art

A conventional audio jack connector has an insulating housing and a plurality of transmitting terminals mounted in the insulating housing. The insulating housing has an inserting hole passing therethrough for receiving a mating audio plug connector. Each of the transmitting terminals has an elastic arm, and a contacting portion extended and bent from a free end of the elastic arm, projecting into the inserting hole. When the audio plug connector is inserted into the inserting hole, the contacting portions abut against a front end of the audio plug connector for transmitting audio signals between the audio plug connector and the audio jack connector. However, after frequent insertions and withdraws, the deformation of the contacting portions are apt to overstep the bound of the transmitting terminals, which makes the contacting portions fail to provide enough elastic force to keep the audio plug connector hold firmly in the audio jack connector to transmit audio signals stably. Therefore, it is desirable and necessary to design an audio jack connector which is able to solve or at least overcome the problem mentioned above.

SUMMARY OF THE INVENTION

Accordingly, an object of the present invention is to provide an audio jack connector adapted for receiving an audio plug connector from a front direction. The audio jack connector has an insulating housing. The insulating housing has an inserting hole extending from a front to rear for receiving the audio plug connector and a plurality of recesses communicating with the inserting hole for receiving a plurality of terminals. An elastic body which is disposed in the inserting hole perpendicular to an extending direction of the inserting hole has two opposite tightening arms and a connecting portion interconnected with opposite ends of the tightening arms. A front end of the audio plug connector passes through the elastic body and is restrained by the elastic body. Two tightening arms of the elastic body are against the portions of the front end of the audio plug connector from opposite directions, when the audio plug connecter is inserted into the inserting hole of the insulating housing.

As described above, the front end of the audio plug connector passes through the elastic body and is restrained between the tightening arms of the elastic body to fasten the audio plug connector firmly in the inserting hole, which will form steady and successive electrical connections between the audio plug connector and the terminals, insuring stable audio signals transmitting between the audio jack connector and the audio plug connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENTS

Figure 1:
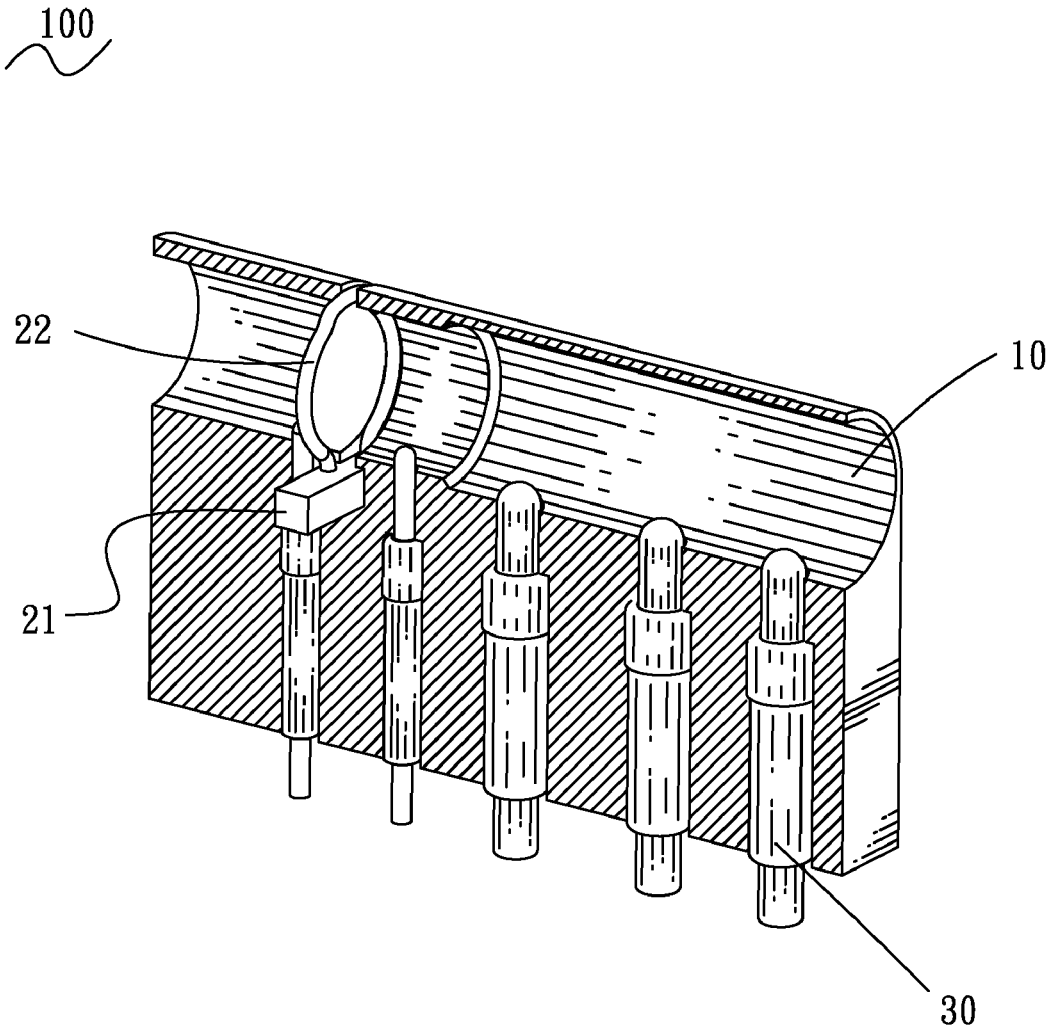
FIG. 1 is a cross-sectional view of an audio jack connector in a first embodiment according to the present invention.
Figure 4:
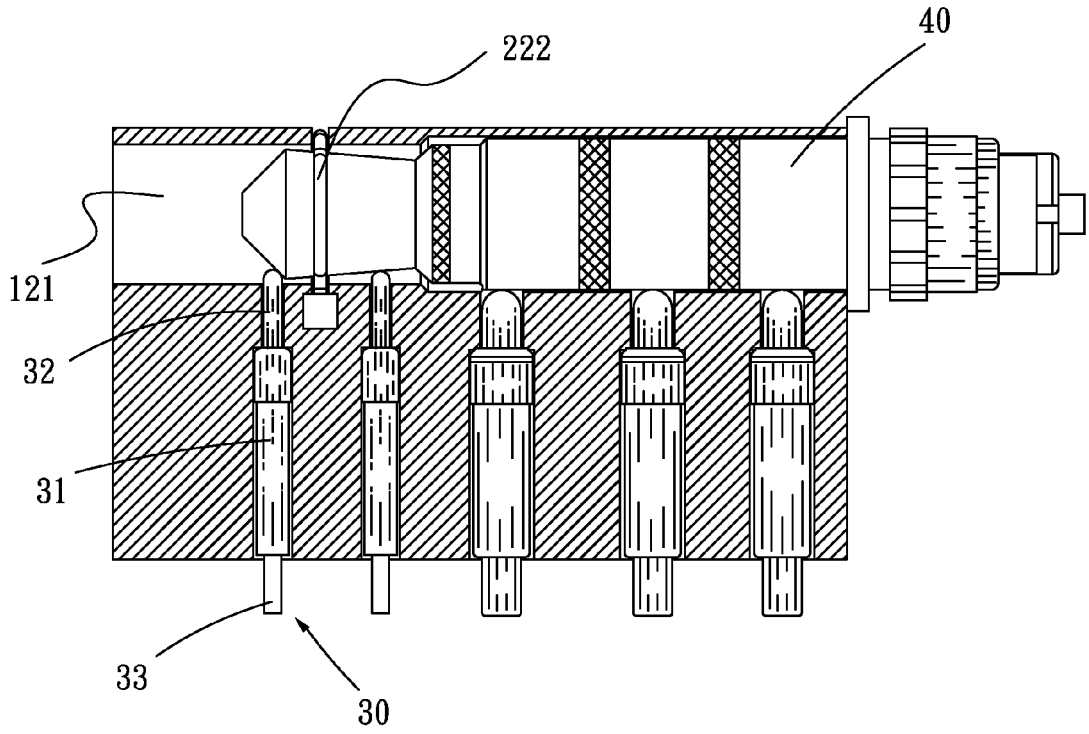
FIG. 4 is a cross-sectional view showing that the audio jack connector shown in FIG. 1 mates with an audio plug connector.

Referring to FIG. 1 and FIG. 4, an audio jack connector 100 according to the present invention is shown. The audio jack 100 includes an insulating housing 10, an elastic element and a plurality of probe assemblies 30 mounted to the insulating housing 10. Herein, supposing an audio plug connector 40 is inserted into the audio jack connector 100 along a front and rear inserting direction, for clear description.

Figure 2:
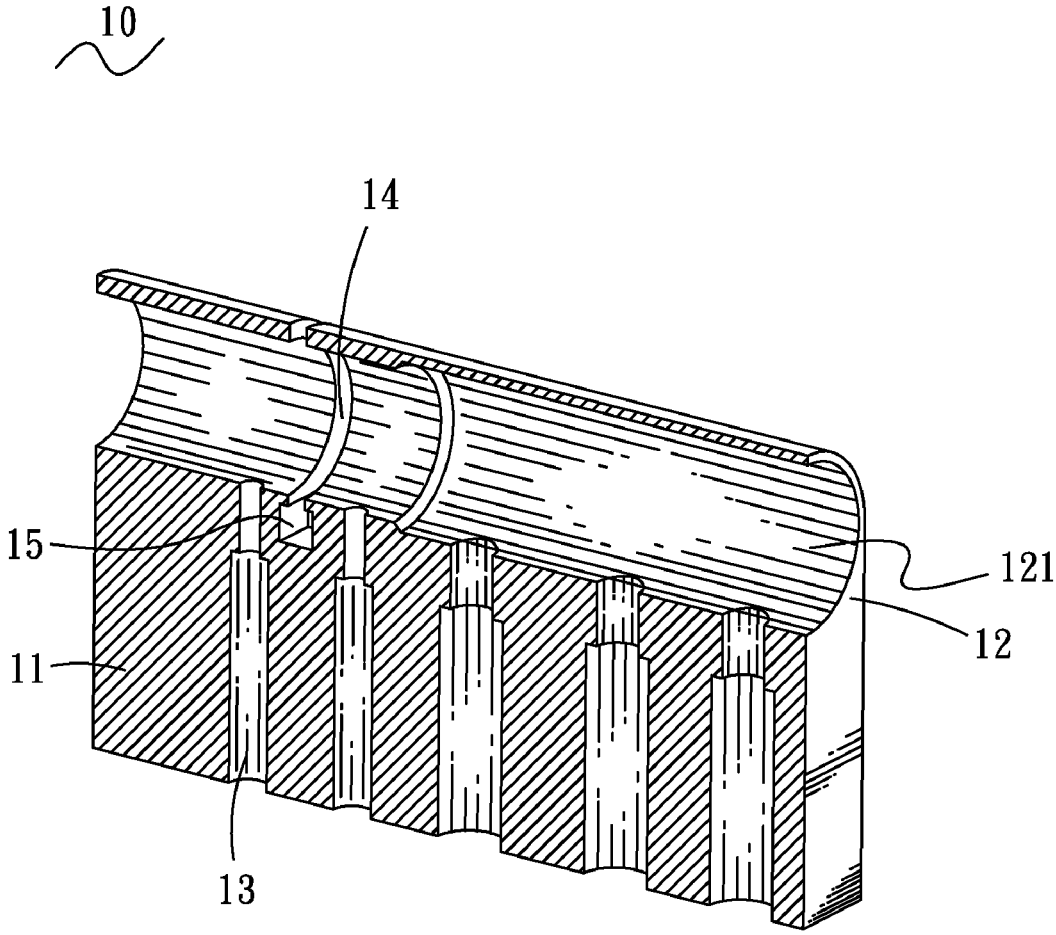
FIG. 2 is a cross-sectional view of an insulating housing of the audio jack connector shown in FIG. 1.

With reference to FIG. 2 and FIG. 4, the insulating housing 10 includes a main body 11 and a mating portion 12 extended upwards from an upper surface of the main body 11. The mating portion 12 has an inserting hole 121 extended from the front to the rear for receiving the inserted audio plug connector 40. The main body 11 has a plurality of recesses 13, each of which is extended along an up and down direction to pass through a bottom surface of the main body 11 and communicates with the inserting hole 121. An inner wall of the inserting hole 121 has a rear portion concaved outwards to form a ring-shaped receiving groove 14 with a top end penetrating a corresponding upper surface of the mating portion 12. A bottom end of the receiving groove 14 connects with a substantially rectangular fixing groove 15 which is extended downwardly towards the main body 11.

Figure 3:
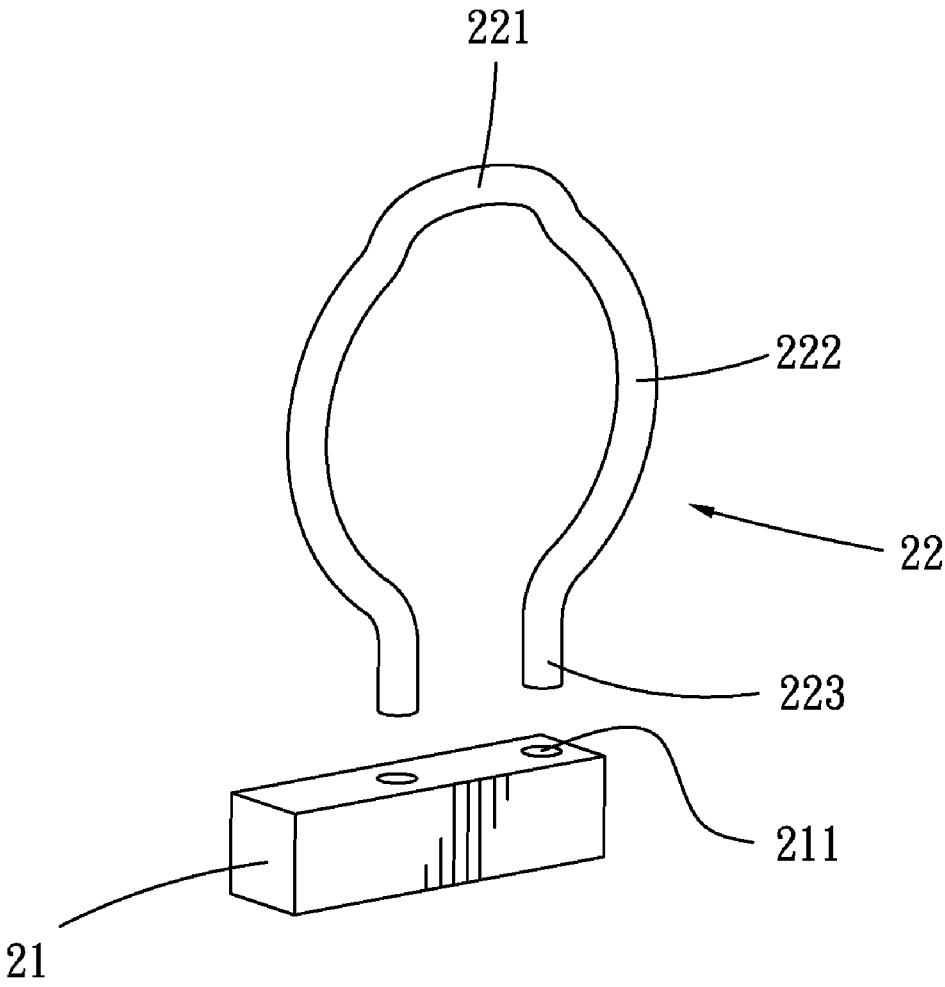
FIG. 3 is an exploded, perspective view of an elastic element of the audio jack connector shown in FIG. 1.

With reference to FIG. 2 and FIG. 3, the elastic element has a rectangular base 21 and a first elastic body 22 mounted on the base 21. The base 21 is formed with two spaced apertures 211. The first elastic body 22 has a first connecting portion 221. Two opposite ends of the first connecting portion 221 are extended and arched oppositely to form two first tightening arms 222 to show a substantial ring-shape with a gap opposite to the first connecting portion 221. Two inserting portions 223 are extended downwards from free ends of the first tightening arms 222 inserted into the apertures 211 to fix the first elastic body 22 on the base 21. The base 21 is located in the fixing groove 15 and the first elastic body 22 is received in the receiving groove 14 so as to mount the elastic element in the insulating housing 10.

With reference to FIG. 4, each of the probe assembles 30 has a barrel 31 integrally molded in the recess 13 of the insulating housing 10. A top end and a bottom end of the barrel 31 are connected with a telescopic probing pin 32 and a soldering portion 33 respectively. The telescopic probing pins 32 extend into the inserting hole 121 for contacting with the inserted audio plug connector 40. The soldering portions 33 expose outside the insulating housing 10 for being soldered to a PCB (not shown).

Figure 5:
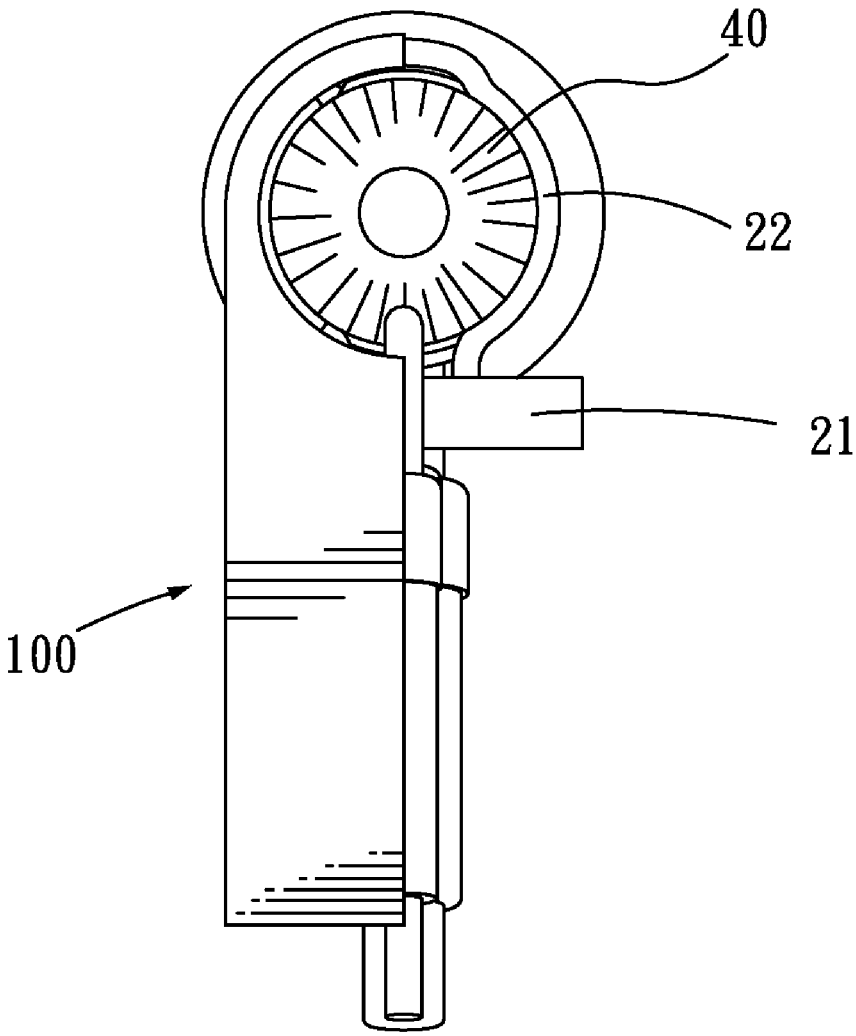
FIG. 5 is a cross-sectional view showing that the audio jack connector shown in FIG. 1 mates with the audio plug connector seen from another direction.

With reference to FIG. 4 and FIG. 5, when the audio plug connector 40 is inserted into the inserting hole 121 of the audio jack connector 100, a front end of the audio plug connector 40 passes through the first elastic body 22 arranged in the rear end of the inserting hole 121 and is restrained by the first elastic body 22. The first tightening arms 222 of the first elastic body 22 are against the audio plug connector 40 from two opposite directions, which makes the audio plug connector 40 hold firmly in the inserting hole 121. The probing pins 32 of the probe assembles 30 projected into the inserting hole 121 contact with the audio plug connector 40, which can form steady and successive electrical connections between the audio plug connector 40 and the audio jack connector 100.

Figure 6:
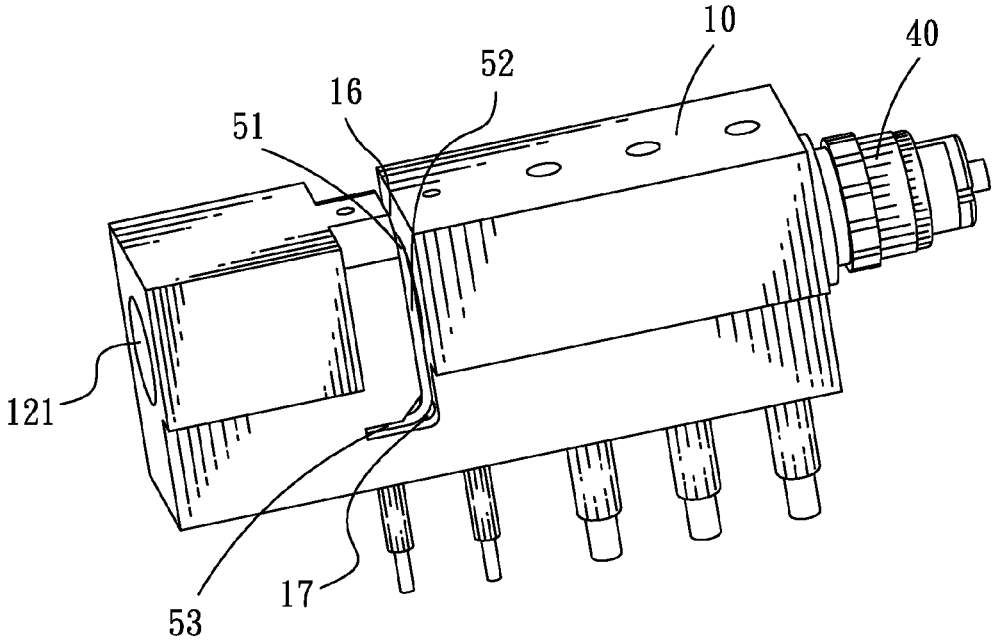
FIG. 6 is a perspective view of an audio jack connector in a second embodiment according to the present invention, wherein the audio plug connector is inserted into the audio jack connector.
Figure 7:
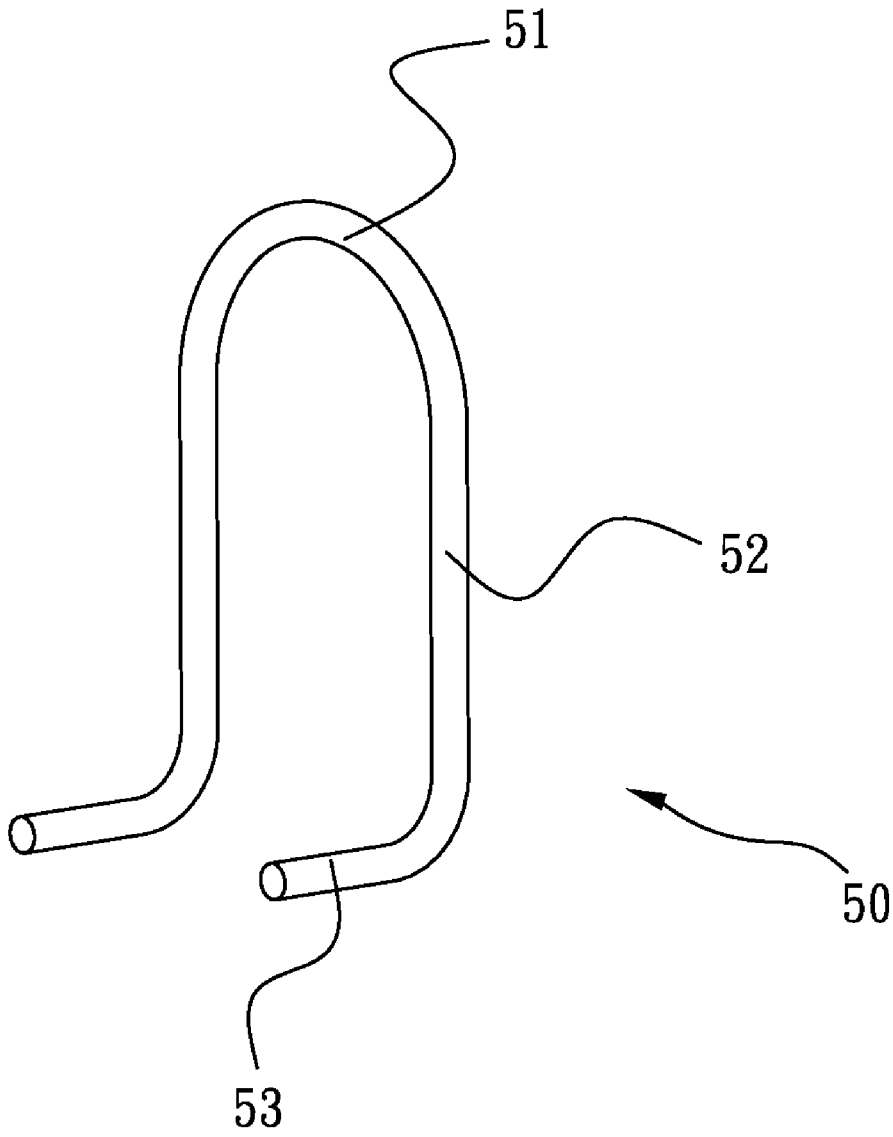
FIG. 7 a perspective view of a second elastic body of the audio jack connector shown in FIG. 6.
Figure 8:
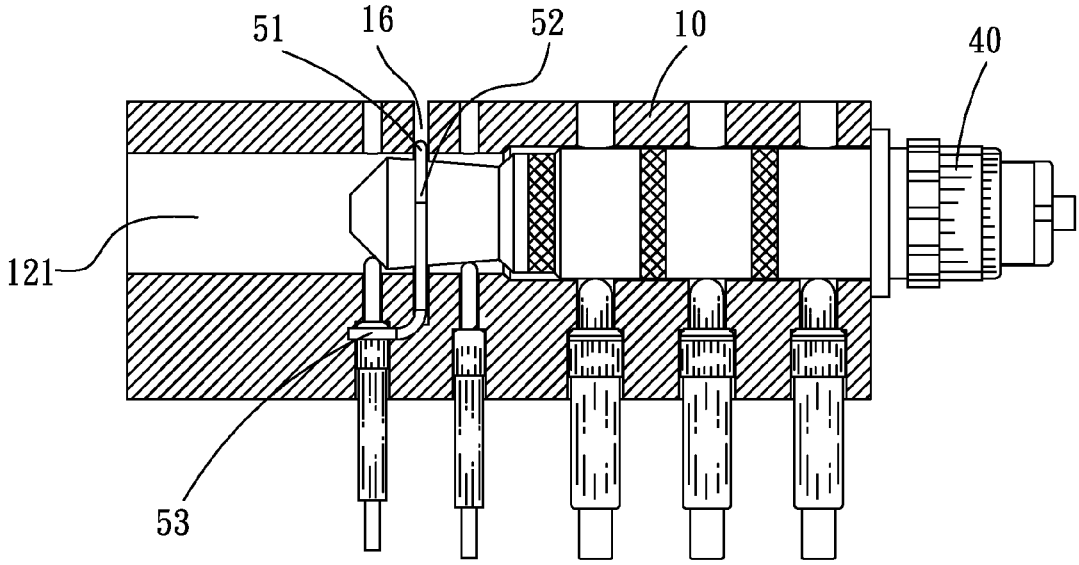
FIG. 8 is a cross-sectional view of the audio jack connector shown in FIG. 6, wherein the audio plug connector is provided.

With reference to FIG. 6, it should be noted that the protection scope of the present invention is not limited to the structure of the embodiment described above, in fact, many structures of the embodiment can be changed equivalently. For example, the elastic element can be replaced by a second elastic body 50. The second elastic body 50 has a second connecting portion 51 and two second tightening arms 52. The second tightening arms 52 are connected with two opposite ends of the second connecting portion 51 to show U-shape. Two free ends of the second tightening arms 52 extend perpendicularly to the second tightening arms 52 to form two facing second inserting portions 53. The insulating housing 10 has a receiving slot 16 which is extended downwards from a top surface of the insulating housing 10. The receiving slot 16 passes through two opposite sides of the insulating housing 10 and communicates with the inserting hole 121. Each of the two opposite sides of the insulating housing 10 has a fixing slot 17 perpendicularly connected with a bottom of the receiving slot 16. The second connecting portion 51 and the second tightening arms 52 are received in the receiving slot 16. The second inserting portions 53 are jammed in the corresponding fixing slots 17. The front end of the audio plug connector 40 is restrained between the two second tightening arms 52 of the second elastic body 50, when the audio plug connector 40 is inserted into the inserting hole 121 of the insulating housing 10, which is also possible to achieve the same or similar effects as described above.

As described above, the front end of the audio plug connector 40 passes through the elastic bodies 22, 50 and is restrained between the tightening arms 222, 52 of the elastic bodies 22, 50 to fasten the audio plug connector 40 firmly in the inserting hole 121, which will form steady and successive electrical connections between the audio plug connector 40 and the probe assemblies 30, insuring stable audio signals transmitting between the audio jack connector 100 and the audio plug connector 40.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An audio jack connector adapted for receiving an audio plug connector from a front direction, comprising:

an insulating housing having an inserting hole extending from a front to rear for receiving the audio plug connector and a plurality of recesses communicating with the inserting hole for receiving a plurality of terminals; and an elastic body disposed in the inserting hole perpendicular to an extending direction of the inserting hole having two opposite tightening arms and a connecting portion interconnected with opposite ends of the tightening arms;

wherein a front end of the audio plug connector passes through the elastic body and is restrained by the elastic body, two tightening arms of the elastic body are against the portions of the front end of the audio plug connector from opposite directions, when the audio plug connector is inserted into the inserting hole of the insulating housing; and wherein the insulating housing has a receiving slot, which is extended downwards from a top surface of the insulating housing, passing through two opposite sides of the insulating housing and communicating with the inserting hole, and two fixing slot at the two opposite sides thereof, each of which is perpendicularly connected with a bottom of the receiving slot, the connecting portion of the elastic body has two opposite ends connected with the two tightening arms to show U-shape and received in the receiving slot, two free ends of the tightening arms extend perpendicularly to form two inserting portions jammed in the corresponding fixing slots.

* * * * *